US007243960B2

(12) United States Patent
Hoshikawa et al.

(10) Patent No.: US 7,243,960 B2
(45) Date of Patent: Jul. 17, 2007

(54) DOUBLE ACTION MECHANISM OF VEHICLE DOOR LATCH DEVICE

(75) Inventors: Tsuguo Hoshikawa, Yamanashi-ken (JP); Jun Odahara, Yamanashi-ken (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 10/500,223

(22) PCT Filed: Dec. 25, 2002

(86) PCT No.: PCT/JP02/13535

§ 371 (c)(1),
(2), (4) Date: Jul. 15, 2005

(87) PCT Pub. No.: WO03/056119

PCT Pub. Date: Jul. 10, 2003

(65) Prior Publication Data

US 2006/0163883 A1 Jul. 27, 2006

(30) Foreign Application Priority Data

Dec. 25, 2001 (JP) ..... 2001-390990

(51) Int. Cl.
*E05C 3/06* (2006.01)

(52) U.S. Cl. ..... 292/216; 292/DIG. 23

(58) Field of Classification Search ..... 292/216, 292/201, DIG. 23; 70/279
See application file for complete search history.

(56) References Cited

U.S. PATENT DOCUMENTS 6,126,212 A * 10/2000 Fujihara ..... 292/216
6,406,073 B1 * 6/2002 Watanabe ..... 292/216

* cited by examiner

*Primary Examiner*—Gary Estremsky
(74) *Attorney, Agent, or Firm*—Browdy and Neimark, PLLC

(57) ABSTRACT

A door latch device has a hook lever 50 for switching a lock lever 36 residing at a locked position L to an unlocked position U when an inner open lever 29 is rotated, and a pressing spring 45 for coupling the lock lever 36 and an open link 41. When the lock lever 36 is switched to the unlocked position U from the locked position L while an outer open lever 28 is in an actuated position Y, although the open link 41 is not displaced to an engaging position, the pressing spring 45 is compressed. The open link 41 is pushed out to the engaging position by elasticity of the pressing spring 45 when the outer open lever 28 is returned to a stand-by position X while the pressing spring 45 is compressed.

2 Claims, 3 Drawing Sheets

DOUBLE ACTION MECHANISM OF VEHICLE DOOR LATCH DEVICE

TECHNICAL FIELD OF THE INVENTION

The present invention relates to a double action mechanism of a vehicle door latch device and particularly to the double action mechanism provided with an anti-panic mechanism.

BACKGROUND ART OF THE INVENTION

In the conventional common vehicle door latch device, unlocking operations by an inside lock button, a remote control transmitter and the like are not normally completed if the outside open handle of a door is in the state of being manipulated by an opening operation, nor is it possible to open the door. Such a state is referred to as a panic state in the industry. If the door is getting into the panic state, the outside open handle is made to return to a non-operation state, then the unlocking operation is made to perform by means of the remote-control transmitter or the like again, after that, the opening operation of the door handle is performed again, so that the door is opened. That is, two unlocking operations and two door opening operations are required until the door is opened. Thus, the state, which necessitates two times of unlocking operation and two times of door-opening operation, is defined as the panic state in the present invention.

The door latch device composed of the anti-panic mechanism, which reduces complicated operation caused by occurrence of the panic state, is known (Japanese Utility Model Application Laid-Open No. 58-101949, and Japanese Patent Application Laid-Open No. 11-324451). The known anti-panic mechanism is to eliminate the second unlocking operation. Even though the first unlocking operation is not completed normally by the first door-opening operation of the outside open handle, a shifting to the unlocked state is completed when the door handle is restored to the non-operation state. Hence, when the second opening operation of the door handle is subsequently performed, it is possible to open the door even if the second unlocking operation is not performed.

Further, there is a conventionally known double action mechanism for shifting the latch device into the unlocked state when an inside open handle is subjected to the opening operation under the locked state, and for releasing the latch device when the inside open handle is subjected to the opening operation again under the unlocked state (Japanese Patent Application Laid-Open No. 2000-303731).

However, conventionally, a door latch device, which is provided with both of the double action mechanism and the anti-panic mechanism, is not developed.

This is not that this combination does not reside simply until now, but difficult combination avoids practical realization. That is, the double action mechanism is a mechanism related to the inside open handle, to the contrary, the anti-panic mechanism is a mechanism related to the outside open handle, and when combining the both simply, to become very large latch device that is not practical.

BRIEF SUMMARY OF THE INVENTION

Therefore, an object of the present invention is to provide a practical door latch device provided with both of a double action mechanism and an anti-panic mechanism.

Further, another object of the present invention is to provide a door latch device with practicality in such a way as to materialize an anti-panic mechanism capable of being constituted by only components of the double action mechanism.

BEST MODE FOR CARRYING OUT THE INVENTION

Figure 1:
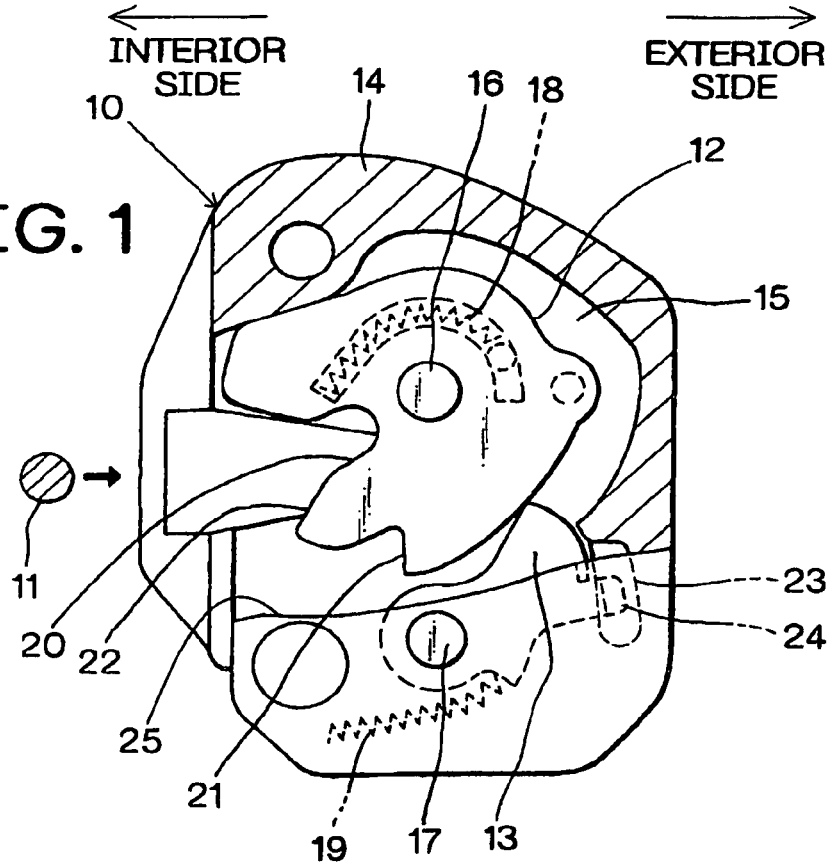
FIG. 1 is a front view of a door latch device of the present invention.

A door latch device of the present invention is constituted by a latch assembly 10 mounted on a door (not shown), and a striker 11 fixed to a vehicle body (not shown). The latch assembly 10 has a latch 12 which is engaged with the striker 11 when closing the door, and a ratchet 13 for maintaining engagement between the latch 12 and the striker 11. The latch 12 is rotatably housed within a recess part 15 formed on the front surface of a latch body 14 by means of a latch shaft 16 extending in a back-and-forth direction, and the ratchet 13 is rotatably housed within the recess part 15 by means of a ratchet shaft 17 extending in the back-and-forth direction.

The latch 12 is, in FIG. 1, urged in the clockwise direction by elasticity of the latch spring 18, and the ratchet 13 is urged in the counterclockwise direction by elasticity of the ratchet spring 19. The latch 12 of FIG. 1 is in an unlatched position according to the elasticity of the latch spring 18. When the door is moved toward a door-closed position, the striker 11 comes into contact with U-shaped groove 20 of the latch 12 to rotate the latch 12 in counterclockwise direction, and when the latch 12 rotates up to a half-latched position, the ratchet 13 is engaged with a first step 21 of the latch 12, so that the door is in a half-closed position. Further, when the latch 12 reaches to a full-latched position, the ratchet 13 is engaged with a second step 22 of the latch 12, so that the door is maintained at a full-closed position.

The ratchet 13 has a ratchet pin 24 which is projected to the rear side of the latch body via an opening 23 of the latch body 14. On the front surface of the latch body 14, a metal cover plate 25 for covering the recess part 15 is fixed. The cover plate 25 is shown partially in FIG. 1.

Figure 2:
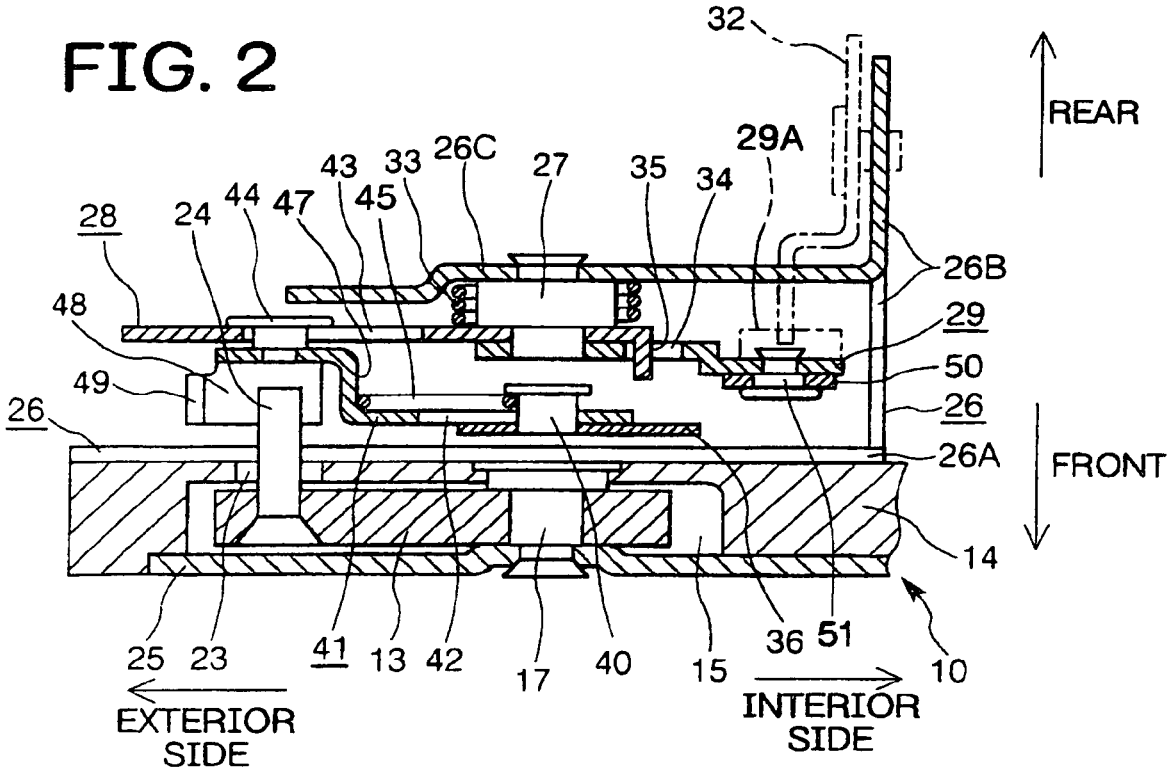
FIG. 2 is a cross sectional view showing a latch assembly of the door latch device.

As shown in FIG. 2, on a rear surface of the latch body 14, a metal back plate 26 is fixed. The back plate 26 has a parallel plate 26A which is approximately parallel with the cover plate 25 and is fixed to the rear surface of the latch body 14, and a bent plate 26B which is bent to extend in the rear direction from an interior side of the parallel plate 26A. To the bent plate 26B, a sub-plate 26C which is approximately parallel with the cover plate 25, is provided integrally or separately.

Figure 3:
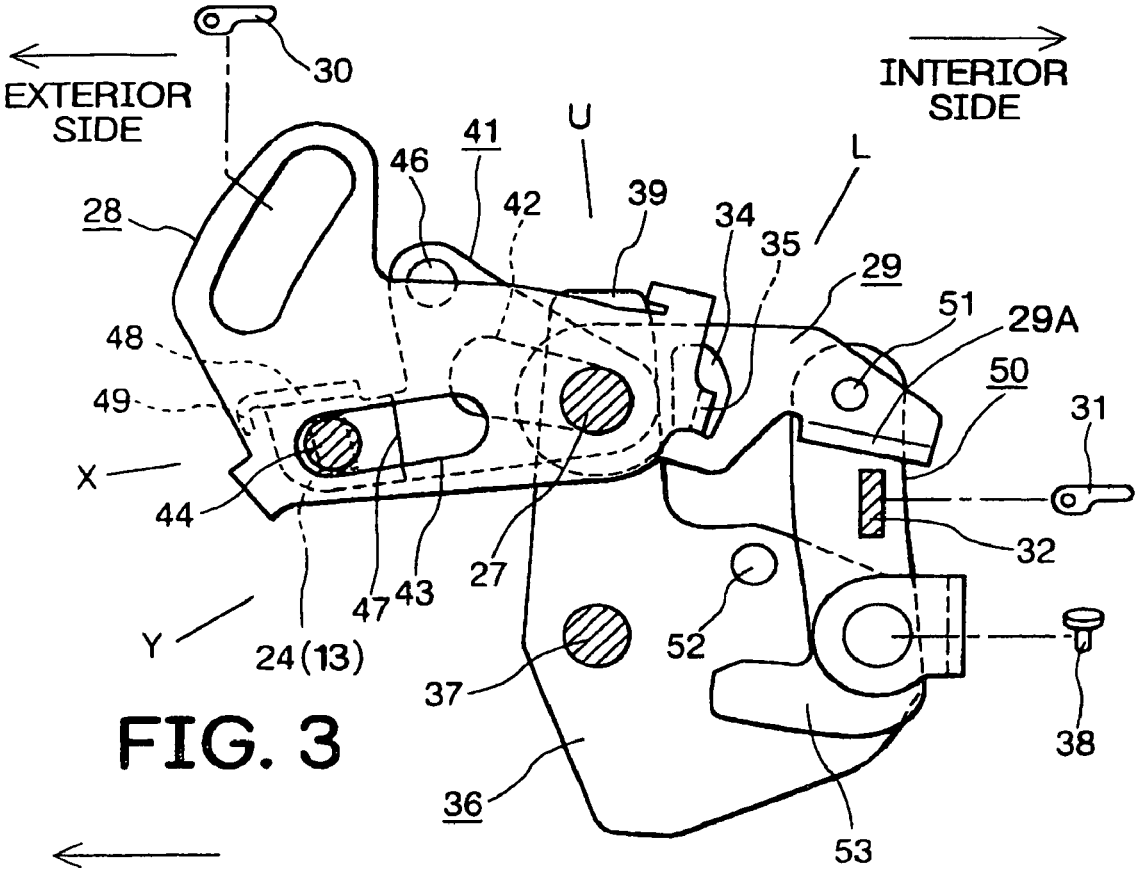
FIG. 3 is a rear view showing lever group in an unlocked state.
Figure 5:
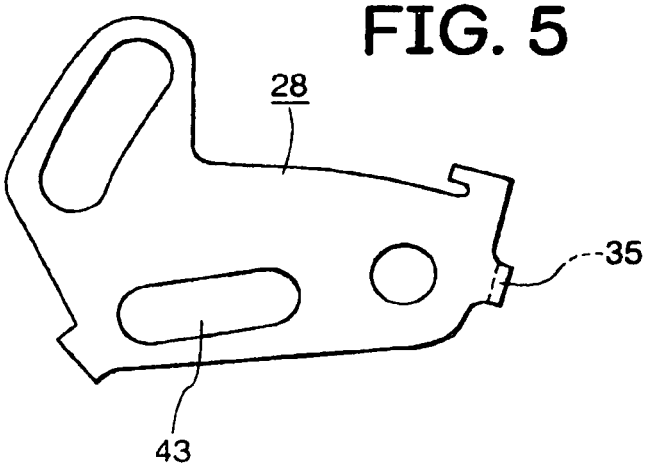
FIG. 5 is a rear view of an outer open lever.
Figure 6:
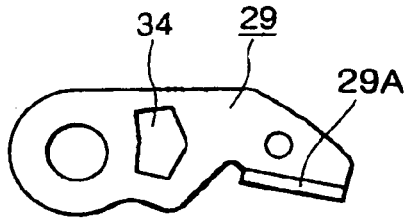
FIG. 6 is a rear view of an inner open lever.

To the sub-plate 26C, an outer open lever 28 (FIG. 5) and an inner open lever 29 (FIG. 6) are pivoted by means of a mounting shaft 27 coaxial with the ratchet shaft 17. As shown in FIG. 3, the outer open lever 28 is connected to an outside open handle 30 of the door via rods, and is rotated counterclockwise from a stand-by position X to an actuated position Y in response to the door-opening operation of the outside open handle 30. A bent portion 29A formed at an interior side portion of the inner open lever 29 is engageable with an end part of a relay lever 32. The relay lever 32 is pivotally mounted on the bent plate 26B and connected to an inside open handle 31 of the door via rods and the like, by this means, the inner open lever 29 is rotated counterclockwise in response to the door-opening operation of the inside open handle 31.

The outer open lever 28 is urged by a returning spring 33 (FIG. 2) from the actuated position Y to the stand-by position X. The outer open lever 28 has a bent part 35 which is engaged with an engaging slot 34 of the inner open lever 29 with a lost-motion coupling. The outer open lever is rotated counterclockwise toward the actuated position Y when the inner open lever 29 is rotated counterclockwise according to the door-opening operation of the inside open handle 31.

Figure 4:
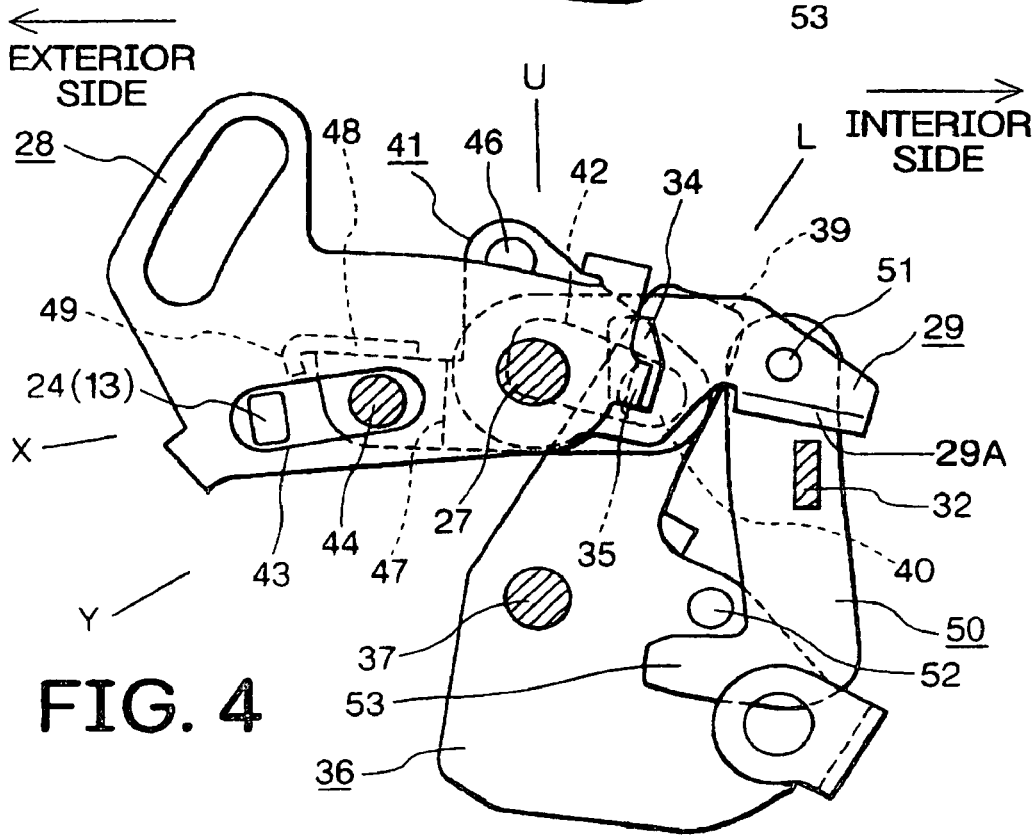
FIG. 4 is a rear view showing lever group in a locked state.

The latch assembly 10 has a lock lever 36 switching the latch assembly 10 into either locked state or unlocked state. The lock lever 36 is pivotally mounted on the latch body 14 or the back plate 26 by a lock shaft 37 extending in the back-and-forth direction, and connected to an inside lock button 38 of the door. In an upper arm 39 of the lock lever 36, a supporting pin 40 is provided. When the lock lever 36 is in the locked position L as shown in FIG. 4 the supporting pin 40 is positioned at right side of the mounting shaft 27. However when the lock lever 36 is switched to the unlocked position U, the supporting pin 40 is displaced to a coaxial position where the supporting pin 40 is aligned with the mounting shaft 27, for this reason, the supporting pin is not shown in FIG. 3.

Figure 7:
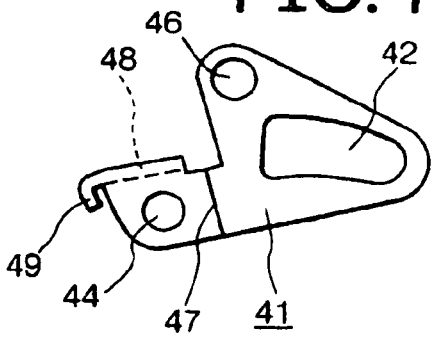
FIG. 7 is a rear view of an open link.
Figure 8:
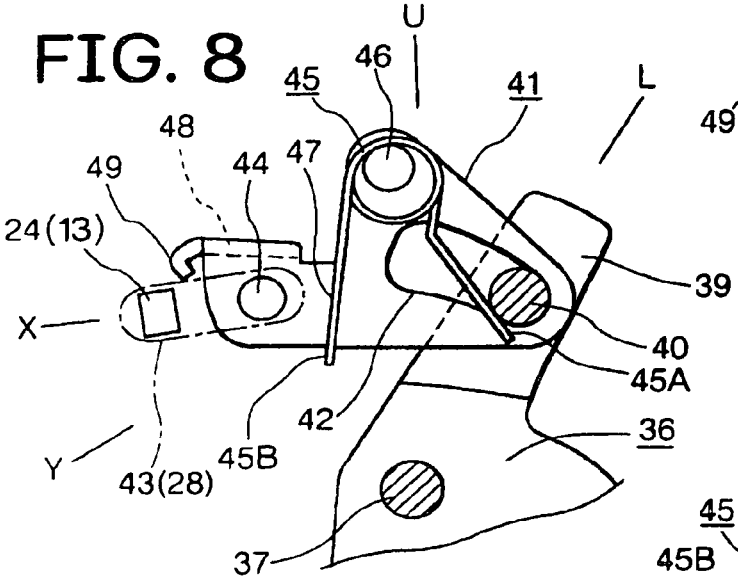
FIG. 8 is a rear view showing relationship between the open link and a ratchet pin in the locked state.
Figure 9:
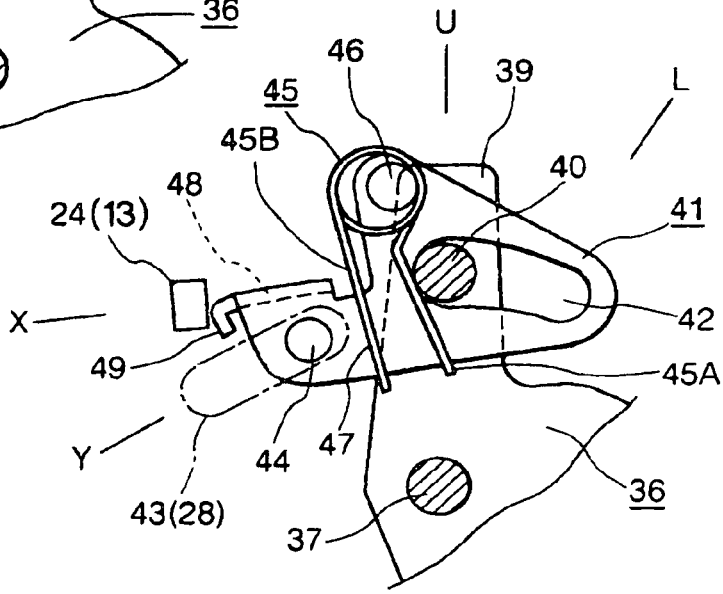
FIG. 9 is a view for explaining the double action mechanism and the anti-panic mechanism.

As shown in FIGS. 8 and 9, the supporting pin 40 is slidably engaged with a supporting slot 42 formed on an open link 41 (FIG. 7). The open link 41 is provided with a guide pin 44 which is slidably engaged with a guide slot 43 formed on the outer open lever 28. The open link 41 is rotated counterclockwise about the supporting pin 40 due to engagement of the guide slot 43 and the guide pin 44 when the outer open lever 28 is rotated counterclockwise in response to the door-opening operation of the outside open handle 30 or the inside open handle 31.

A pressing spring 45 is provided between the supporting pin 40 and the open link 41. The pressing spring 45 is mounted on a stud 46 of the open link 41. The first leg part 45A of the pressing spring comes into contact with the supporting pin 40, and the second leg part 45B comes into contact with a step part 47 of the open link 41. The open link 41 is urged in the leftward direction by the pressing spring 45.

A first contact part 48 is provided on an exterior side portion of the open link 41. When the lock lever 36 is switched to the unlocked position U from the locked position L as shown in FIG. 3, the open link 41, which is pushed out in the leftward direction by the pressing spring 45, is displaced into an engaging position where the first contact part 48 is engageably opposed to the ratchet pin 24 in the up-and-down direction. In this unlocked state, when the outer open lever 28 moves from the stand-by position X to the actuation position Y and the open link 41 is rotated counterclockwise about the supporting pin 40 as the center due to engagement of the guide slot 43 and the guide pin 44, the first contact part 48 comes into contact with the ratchet pin 24 to move the ratchet pin 24 downward, by this means, the ratchet 13 is separated from the latch 12 so as to open the door.

When the inside lock button 38 is subjected to locking operation in the state shown in FIG. 3, the lock lever 36 is switched to the locked position L from the unlocked position U, the open link 41 then moves rightward as shown in FIG. 4, and the first contact part 48 is displaced to a disengaging position where the first contact part 48 is disengageabe with the ratchet pin 24. In this locked state, even though the open link 41 is rotated counterclockwise in response to the displacement of the outer open lever 28 from the stand-by position X to the actuated position Y, the ratchet pin 24 can not be moved downward, accordingly, the door is held in the opening state.

Further, a second contact part 49 is provided on the exterior side portion of the open link 41. When the outer open lever 28 moves to the actuated position Y from the stand-by position X while the lock lever 36 is in the locked position L, the second contact part 49 moves downward in FIG. 4 and is engageably opposed to the ratchet pin 24 in the left-and-right direction. In this state, even though the open link 41 is intended to move leftward toward the engaging position in response to the unlocking operation of the lock lever 36, the open link 41 can not move leftward by contact between the second contact part 49 and the ratchet pin 24 as shown in FIG. 9. However, the lock lever 36 can be displaced to the unlocked position U by pressing the pressing spring 45.

On the inner open lever 29, an inverse L-shaped hook lever 50 is pivotally mounted by a pin 51. The hook lever 50 is provided with a hook part 53 on the bottom thereof which is engageable with engaging pin 52 mounted on the lock lever 36. In the locked state of FIG. 4, the hook lever 50 makes the lock lever 36 displace to the unlocked position U due to contact between the hook part 53 and the engaging pin 52 when the inner open lever 29 is rotated counterclockwise by the door-opening operation of the inside open handle 31.

OPERATION (Double Action Mechanism)

In the locked state of FIG. 4, when the inner open lever 29 is rotated counterclockwise in response to the door-opening operation of the inside open handle 31, the outer open lever 28 is rotated counterclockwise toward the actuated position Y from the stand-by position X by engagement between the engaging slot 34 and the bent part 35, and the open link 41 is rotated counterclockwise by engagement between the guide pin 44 and the guide slot 43 of the outer open lever 28. By this means, the second contact part 49 moves downward to shift to the side of the ratchet pin 24, however, since the first contact part 48 does not come into contact with the ratchet pin 24, the door is not opened. At the same time, the hook lever 50 moves upward in response to counterclockwise rotation of the inner open lever 29, and the hook part 53 pushes up the engaging pin 52, and the lock lever 36 is rotated counterclockwise toward the unlocked position U.

When the lock lever 36 starts displacement towards the unlocked position U, the supporting pin 40 of the lock lever 36 pushes the open link 41 leftward toward the engaging position from disengaging position via elasticity of the pressing spring 45, however, as shown in FIG. 9, since the second contact part 49 comes into contact with the ratchet pin 24, the open link 41 can not move to the left. However, the lock lever 36 is further capable of counterclockwise-rotating upon compressing the pressing spring 45, as a result, as shown in FIG. 9, the lock lever 36 is displaced to the unlocked position U.

When state of FIG. 9 is formed upon the door-opening operation of the inside open handle 31 in the locked state, the inside open handle 31 is made to return to non-actuation position. Then, the outer open lever 28 is made to return to the stand-by position X by elasticity of returning spring 33, then the second contact part 49 of the open link 41 moves upward than the ratchet pin 24, by this means, the open link 41 is pushed out leftward by elasticity of the pressing spring 45 to be displaced to the engaging position, so that the latch assembly 10 becomes the unlocked state of FIG. 3. Thus, when making the door-opening operation for the inside open handle 31 once in the locked state, although the door is not opened, the latch assembly 10 is switched to the unlocked state from the locked state.

In the unlocked state of FIG. 3, when executing door-opening operation by the inside open handle 31 again, the outer open lever 28 is rotated counterclockwise, the open link 41 is then rotated counterclockwise about the supporting pin 40 as the center by engagement between the guide slot 43 and the guide pin 44, and the first contact part 48 of the of the open link 41 causes the ratchet pin 24 to move downward, thereby, the latch 12 is separated from the ratchet 13 so as to open the door.

According to this, the latch assembly 10 of the present invention, by the first door-opening operation of the inside open handle 31 in the locked state, is switched to the unlocked state, then, by the second door-opening of the inside open handle 31 in the unlocked state, the latch assembly 10 is released to carry out the door-opening of the door. This is double action mechanism.

In the above description, members constituting the double action mechanism such as the outer open lever 28, the inner open lever 29, the lock lever 36, the open link 41, the hook lever 50 and the like, are provided with parallel movement surface to rotational surface of the latch 12 or the ratchet 13, accordingly, the members are mounted on rear side of the latch body 14 compactly.

(Anti-Panic Mechanism)

In the locked state of FIG. 4, when performing door-opening operation of the outside open handle 30, the outer open lever 28 is rotated counterclockwise to be displaced to the actuated position Y, the open link 41 is then rotated counterclockwise about the supporting pin 40 as the center by engagement between the guide slot 43 and the guide pin 44. At this time, the first contact part 48 of the open link 41 does not engage with the ratchet pin 24, thereby the opening of the door is not performed. In the state that the outer open lever 28 is in the actuated position Y, when the inside lock button 38 is subjected to the unlocking operation, the lock lever 36 starts to be displaced toward the unlocked position U. Due to displacement of the lock lever 36, the supporting pin 40 of the lock lever 36 pushes out the open link 41 leftward from the disengaging position to the engaging position via elasticity of the pressing spring 45. However, as shown in FIG. 9, since the second contact part 49 comes into contact with the ratchet pin 24, the open link 41 can not move to the left. However, the lock lever 36 is capable of further counterclockwise-rotating upon compressing the pressing spring 45 with the result that, as shown in FIG. 9, the lock lever 36 is displaced to the unlocked position U.

In the state of FIG. 9, when leaving grip from the outside open handle 30, the outer open lever 28 is returned to the stand-by position X by elasticity of the returning spring 33, then the second contact part 49 of the open link 41 moves upward than the ratchet pin 24, by this means, the open link 41 is pushed out leftward by elasticity of the pressing spring 45 to be displaced to the engaging position, so that the latch assembly 10 becomes unlocked state of FIG. 3. Accordingly, by the door-opening operation of the outside open handle 30, although the unlocking operation of the Inside lock button 38 is not completed normally, when the outside open handle 30 is made to return to the stand-by position X, since switching for the unlocked state is completed in such a way as to follow this, the door-opening becomes possible by the second door-opening operation by the outside open handle 30, without performing second unlocking operation by the inside lock button 38. Thus it is possible to eliminate the panic state smoothly.

EFFECT OF THE INVENTION

As described above, in the present invention, the door latch device with practicality can be provided upon materializing the anti-panic mechanism capable of being constituted by only components of the double action mechanism.

The invention claimed is:

1. A vehicle door latch device comprising:

an outer open lever displaceable to an actuated position Y from a stand-by position X in response to an opening operation of an outside open handle of a door;

an inner open lever arranged to displace the outer open lever when rotated by an opening of an inside open handle of the door;

a lock lever for connection to an inside lock button of the door and displaceable between an unlocked position U and a locked position L;

an open link arranged to be displaced into an engaging position in which displacement of the outer open lever is transmitted to a ratchet pin of a ratchet when the lock lever is in the unlocked position U and to be displaced into a disengaging position in which the displacement of the outer open lever is not transmitted to the ratchet pin of the ratchet when the lock lever is in the locked position U;

a hook lever provided on the inner open lever for switching the lock lever residing at the locked position L to the unlocked position U in response to the rotation of the inner open lever; and a pressing spring connecting the lock lever and the open link;

wherein when switching the lock lever to the unlocked position U from the locked position L while the outer open lever is in the actuated position Y, the pressing spring is compressed although the open link is not displaced to the engagement position;

wherein the outer open lever is returned to the stand-by position X at the time of the state where the pressing spring is compressed, the open link is pushed out toward the engaging position by elasticity of the pressing spring.

2. The vehicle door latch device according to claim 1, wherein the open link has a second contact part which restricts the displacement of the open link toward the engaging position by being engageably opposed to the ratchet pin when the lock lever is in the locked position L and the outer open lever is in the actuated position Y.

* * * * *